US006781070B1

(12) United States Patent
Holt

(10) Patent No.: US 6,781,070 B1
(45) Date of Patent: Aug. 24, 2004

(54) INDEXING ROTARY SWITCH

(75) Inventor: Karl K. Holt, Hartland, WI (US)

(73) Assignee: Herker Industries, Inc., Menomonee Falls, WI (US)

( * ) Notice: Subject to any disclaimer, the term of this patent is extended or adjusted under 35 U.S.C. 154(b) by 0 days.

(21) Appl. No.: 10/353,503

(22) Filed: Jan. 29, 2003

(51) Int. Cl.[7] ..... H01H 19/58
(52) U.S. Cl. ..... 200/11 R; 200/14; 200/570
(58) Field of Search ..... 200/11 R, 14, 200/11 A, 11 J, 11 TC, 17 R, 570, 571, 336

(56) References Cited

U.S. PATENT DOCUMENTS

| | | | | | |
|---|---|---|---|---|---|
| 3,177,306 | A | * | 4/1965 | Mastney | 200/11 D |
| 3,248,490 | A | * | 4/1966 | Allison et al. | 200/14 |
| 3,308,249 | A | * | 3/1967 | Cullen | 200/14 |
| 4,419,546 | A | | 12/1983 | Arthur | 200/11 G |
| 4,521,672 | A | | 6/1985 | Fronius | 219/130.33 |
| 4,532,387 | A | | 7/1985 | Pliml, Jr. | 200/11 R |
| 4,533,816 | A | | 8/1985 | Reeh et al. | 219/137.31 |
| 4,540,871 | A | | 9/1985 | Corrigall et al. | 219/137.63 |
| 4,737,608 | A | | 4/1988 | Jones | 200/564 |
| 4,891,476 | A | | 1/1990 | Nation et al. | 200/11 R |
| 4,910,364 | A | * | 3/1990 | Garcia | 200/11 A |
| 5,049,709 | A | | 9/1991 | Prickett et al. | 200/527 |
| 5,132,513 | A | | 7/1992 | Ingwersen et al. | 219/137.31 |
| 5,260,546 | A | | 11/1993 | Ingwersen et al. | 219/137.31 |
| 5,687,836 | A | | 11/1997 | Gjerde | 200/569 |
| 5,698,122 | A | | 12/1997 | Lubieniecki et al. | 219/137.31 |
| 5,728,982 | A | | 3/1998 | Rao et al. | 200/6 R |
| 6,060,669 | A | * | 5/2000 | Dohnal et al. | 200/11 TC |

* cited by examiner

*Primary Examiner*—Michael A. Friedhofer
(74) *Attorney, Agent, or Firm*—Boyle, Fredrickson, Newholm, Stein & Gratz, S.C.

(57) ABSTRACT

A rotary indexing switch includes a base having a series of radially spaced stationary contact areas, and a rotary contact member having a rotary contact area. The stationary contact areas are defined by contact members engaged within passages in an insulating ring in a configuration dictated by specifications of the switch. The switch has a number of unique features, including mating engagement structure that drivingly engages actuator shafts of stacked switch assemblies; a spring for biasing the rotary contact member toward the stationary contact areas; a combination lift and detent arrangement for lifting the rotary contact areas away from the stationary contact areas and maintaining the rotary contact member in a contact position when the rotary contact areas are engaged with the stationary contact areas; a center contact selectively engageable with the base utilizing a cooperating engagement arrangement; and an integral enclosure wall which forms a dust shield.

40 Claims, 12 Drawing Sheets

FIG. 2
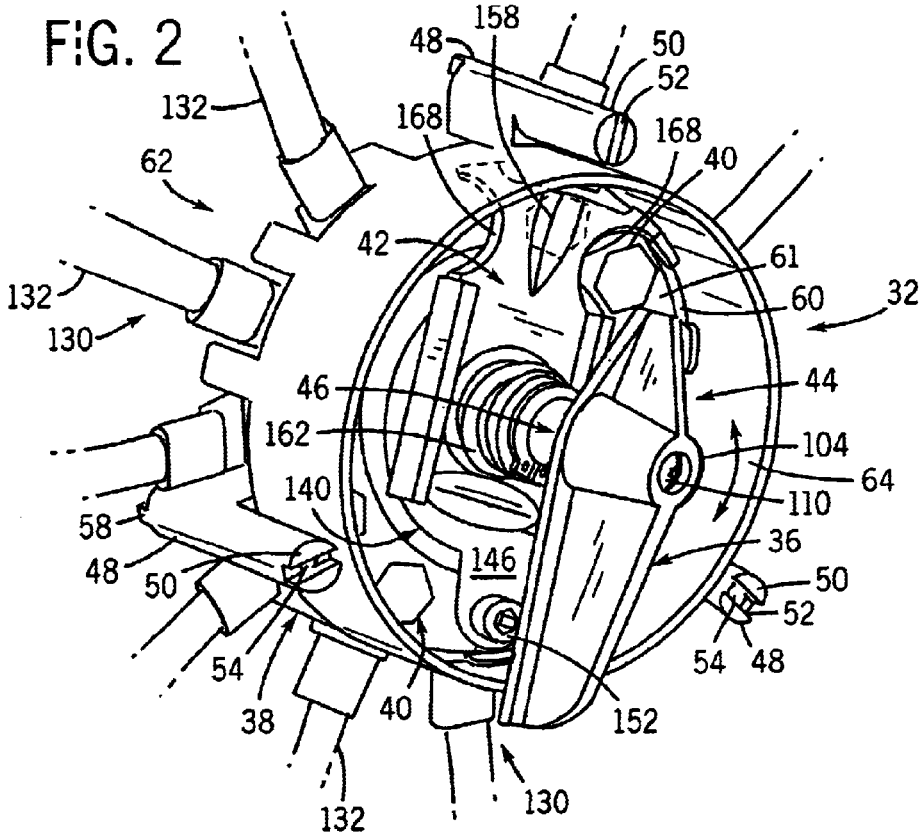
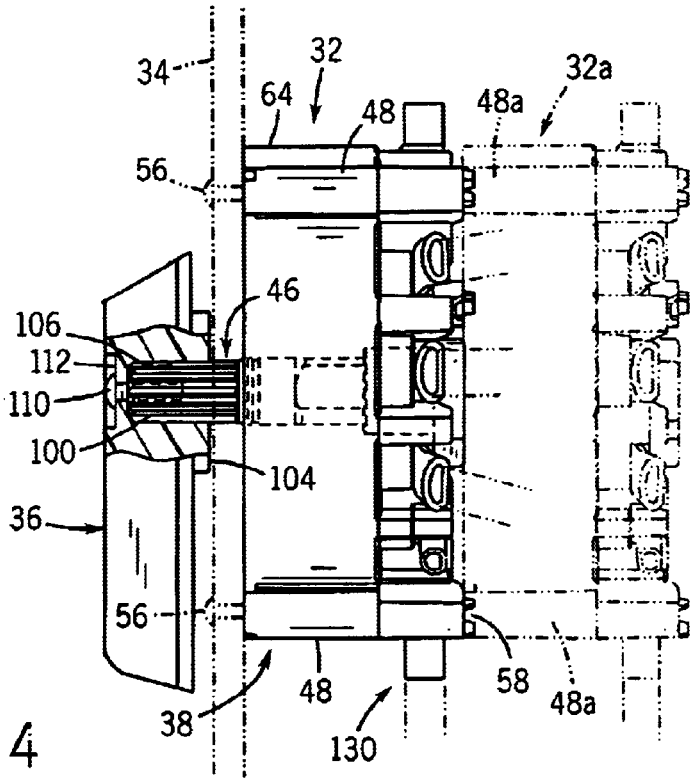
FIG. 4

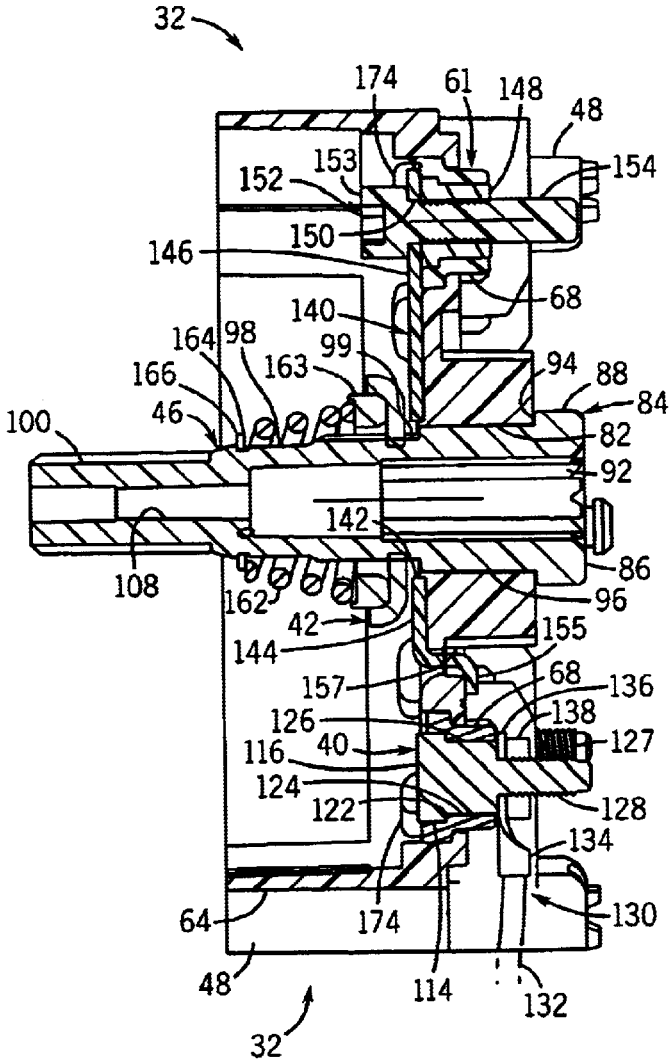
FIG. 7
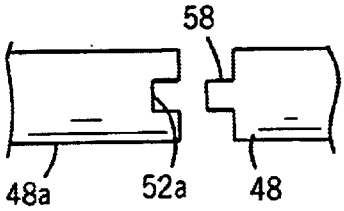
FIG. 8
FIG. 11
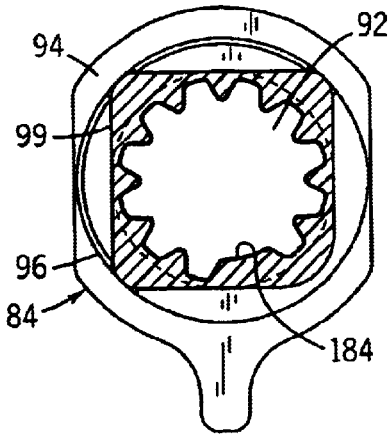
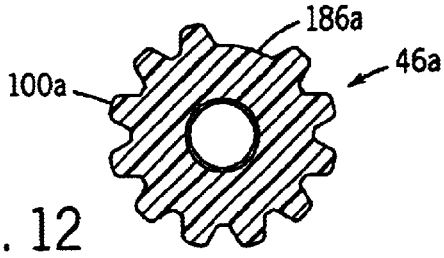
FIG. 12

FiG. 18
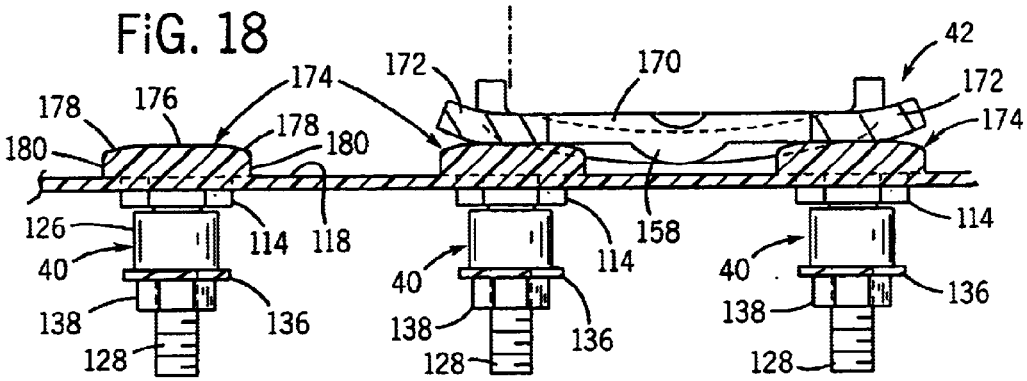
FiG. 19
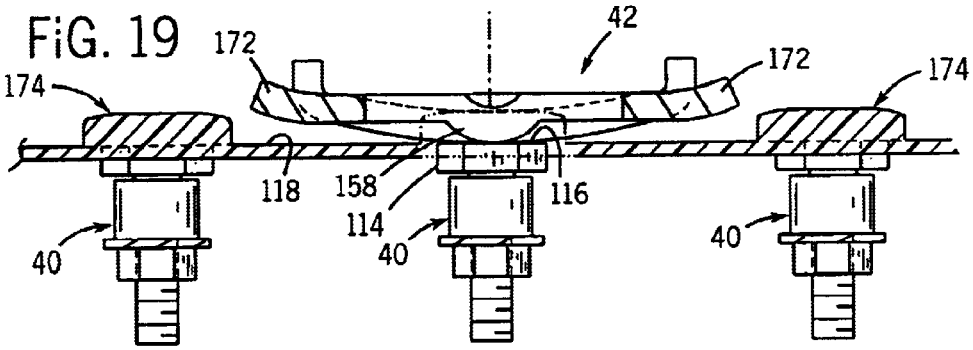
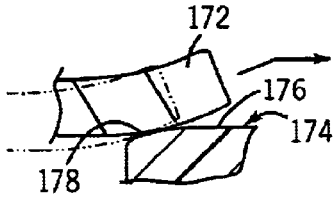
FiG. 20
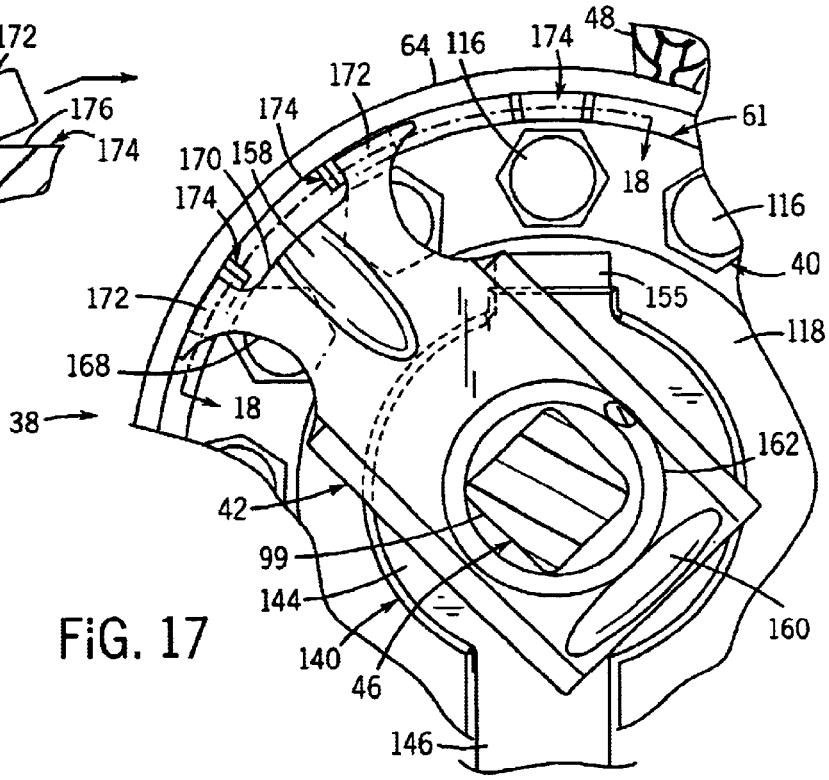
FiG. 17

FIG. 24
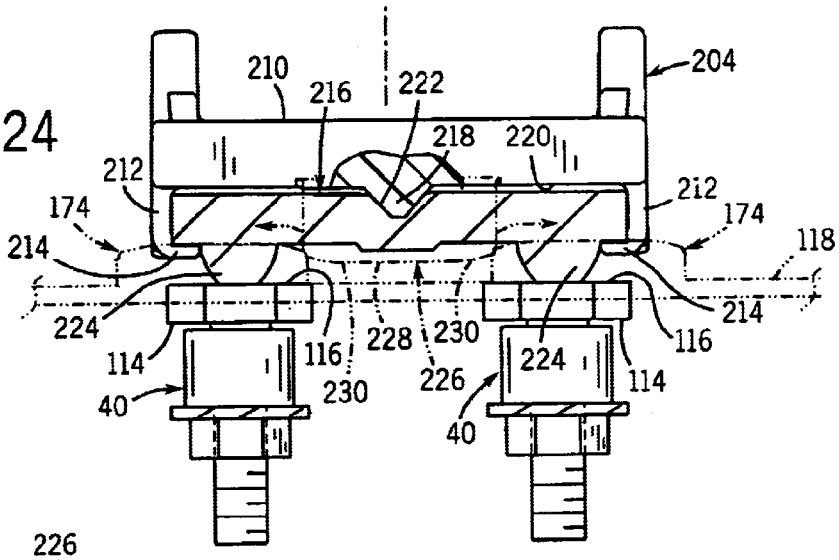
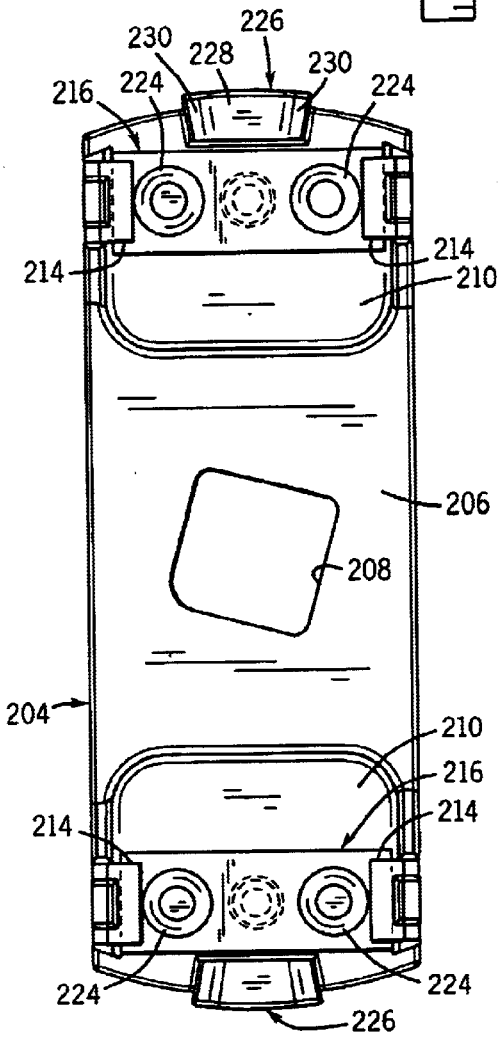
FIG. 23

INDEXING ROTARY SWITCH

BACKGROUND AND SUMMARY OF THE INVENTION

This invention relates to an electrical switch, and more particularly to a rotary indexing electrical switch assembly.

An indexing rotary switch is employed in applications to control operating characteristics or parameters. In a representative application, an indexing rotary switch assembly is employed in an electrical arc welder to control current flow or other settings. A different electrical contact configuration is attained at each position of the rotary switch assembly, to set the parameters of operation.

A prior art rotary switch assembly utilizes a plastic injection molded base with a series of radially spaced contact members insert molded into the base. Each contact member defines a flat front surface which is flush with a front surface defined by the base, and a rearwardly or outwardly facing threaded passage. The base is configured such that the rearwardly or outwardly facing passage is exposed, and the lead of a cable is connected to the contact member via a threaded screw which extends into the passage. The prior art construction further involves use of a dust shield, formed separately from the base. The dust shield has a cylindrical wall which engages the outer peripheral edge of the base outwardly of the contact surfaces of the contact members. A rotary contact member is secured to and rotatable with an actuator shaft, which extends through a central opening formed in the base. In one version, a center contact is insert molded into the material of the base along with the outer contact members, and the rotary contact member establishes a connection between the center contact and one of the contact members. In another version in which the center contact is omitted, the rotary contact member selectively establishes a connection between selected pairs of the radially spaced contact members.

While the above-described construction has been found to function satisfactorily, it involves certain drawbacks in manufacture, assembly and operation. For example, insert molding of the outer contact members and the center contact is sensitive and labor intensive, in that the insert molded components must be manually placed within the mold in accurate positions since the contact positions cannot be altered after the insert molding process. This construction can lead to high rates of part rejection, since the contact positions are subject to very tight tolerances so as to ensure proper operation.

It is an object of the present invention to provide an indexing rotary contact switch having a number of design, manufacturing and operating enhancements as compared to prior art indexing rotary contact switches. It is a further object of the invention to provide such a rotary contact switch having a reduced cost of manufacture and which reduces the rate of part rejection. Yet another object of the invention is to provide such a rotary contact switch which is capable of being produced in a wide range of switch contact configurations utilizing common parts. A still further object of the invention is to provide such a switch assembly which entails use of a relatively small number of components so as to reduce manufacturing costs and increase reliability and quality. Yet another object of the invention is to provide such a rotary contact switch which eliminates insert molding of the contacts with the base. A still further object of the invention is to provide such a rotary contact switch which is relatively simple in its design and manufacture, yet which entails a number of advantages in part manufacture, assembly and overall operation.

In accordance with the invention, an indexing rotary contact switch assembly includes a base having a series of radially spaced stationary contact areas, and a rotary contact arrangement mounted for rotary movement relative to the base. The rotary contact arrangement includes at least one rotary contact area, and is movable to a plurality of contact positions in which the rotary contact area of the rotary contact arrangement engages at least one of the stationary contact areas of the base.

The base is preferably formed so as to include a series of radially spaced passages, and the stationary contact areas are defined by contact members received within certain passages in the base. The contact members are engaged within the passages according to the desired configuration of the switch assembly, so as to place the contact areas in certain locations on the base. The contact members are secured to the base after production of the base, so that the same base can be used to form a base assembly with a variety of contact configurations. In one form, the base is formed so as to define a generally circular opening, and the passages are formed in an insulating ring that is engaged within the generally circular opening. The insulating ring is configured to close the opening. In this manner, the forward portion of the base, within which the stationary contact areas and the rotary contact arrangement are located, is isolated from the environment in which the switch assembly is employed, such as within the interior of the housing of an electrical arc welder or the like. The insulating ring may be formed to have any number of openings in any desired configuration, to provide flexibility in the design and manufacture of the switch assembly.

A combination lift and detent arrangement is interposed between the base and the rotary contact arrangement. The lift and detent arrangement functions to lift the rotary contact area away from the stationary contact areas of the base upon rotation of the rotary contact arrangement between the stationary contact areas, and releasably maintains the rotary contact arrangement in a contact position in which the rotary contact area is in contact with at least one of the stationary contact areas of the base. The lift and detent arrangement preferably includes ramp structure formed integrally with the base, and at least one lift member associated with the rotary contact arrangement. The lift member engages the ramp structure upon rotation of the rotary contact arrangement to lift the rotary contact area away from the base, and engages the ramp structure when the rotary contact member is stationary so as to maintain the rotary contact arrangement in the contact position. The ramp structure may be in the form of a series of individual radially spaced ramps formed integrally with the base, and each ramp is preferably located so as to correspond in location to one of the stationary contact areas.

The switch assembly may include a center contact selectively engageable with the base and defining a stationary center contact area. The rotary contact arrangement includes a rotary inner contact area engageable with the stationary center contact area. The center contact and the base include cooperating engagement structure for engaging the center contact with the base subsequent to manufacture of the base. The center contact includes an opening through which an actuator shaft associated with the rotary contact arrangement extends. The cooperating engagement structure may be in the form of a fastener engaged between the center contact and the base on one side of the opening, in combination with a tab formed on the center contact and engageable within an opening in the base, on the opposite side of the opening.

The actuator shaft of the rotary contact arrangement includes a forward section located forwardly of the base and a rearward section located rearwardly of the base. The forward section of the actuator shaft is adapted to mount an actuator handle which is manually engageable by a user for imparting rotation to the rotary contact arrangement. A second rotary indexing switch assembly is adapted for mounting rearwardly of the base of the first-mentioned switch assembly, and the respective switch assemblies include respective first and second actuator shafts. The actuator shafts are similarly constructed, and the forward section of the second actuator shaft is adapted to be received within an opening in the rearward section of the first actuator shaft. Mating engagement structure is interposed between the first and second actuator shafts, for imparting rotation to the second actuator shaft upon rotation of the first actuator shaft. The mating engagement structure may be in the form of radially spaced axially extending splines which function to rotate the second actuator shaft upon rotation of the first actuator shaft. A positioning arrangement, such as a missing spline, may be provided for positioning the second actuator shaft in a predetermined orientation relative to the first actuator shaft.

The switch assembly further includes a conical spring arrangement interposed between the actuator shaft and the rotary contact member, for biasing the rotary contact member toward the radially spaced stationary contact areas of the base. The conical spring defines a passage through which the actuator shaft extends, and includes a first end spaced from the rotary contact member and a second end in engagement with the rotary contact member. The second end has a transverse dimension greater than the first end. A spring retaining member, such as a snap ring, is engaged with the actuator shaft for engaging the first end of the conical spring, to compress the spring and to bias the contact member toward the stationary contact areas of the base.

The base preferably has an integrally formed enclosure wall which extends from the surface of the base containing the stationary contact areas. The contact areas are contained in a contact surface defined by the base, and the enclosure wall cooperates with the contact surface to define an internal cavity within which the stationary contact areas and the rotary contact member are located. The enclosure wall is adapted to engage a planar member to which the switch assembly is mounted, such as the wall of the welder housing, for enclosing the internal cavity defined by the enclosure wall and the contact surface.

The switch assembly further includes a selectably positionable stop arrangement interposed between the rotary contact arrangement and the base for controlling the range of rotary movement of the rotary contact arrangement relative to the base. The stop arrangement includes a pair of stop members which are engageable with the base in varying locations. The actuator shaft includes an engagement member which engages the stop members upon rotation, to control the range of rotary movement of the rotary contact arrangement.

The base and the actuator shaft can be employed to mount either a first contact member or a second contact member to the rotary switch assembly. The first contact member includes a first contact arrangement adapted to engage the stationary contact areas in a first configuration, and the second contact member includes a second contact arrangement adapted to engage the stationary contact members in a second configuration. A differently configured switch assembly is attained by engaging either the first contact member or the second contact member with the actuator shaft, and rotatably mounting the selected contact member and the actuator shaft to the base.

The invention further contemplates a method of producing a base having a selectively configurable stationary contact arrangement, substantially in accordance with the foregoing summary.

The various features of the invention may be employed independently, and each is capable of improving an aspect of operation or assembly of a rotary indexing switch assembly. In a preferred form, the various aspects can be employed in combination to provide a rotary indexing switch assembly with significant advantages in assembly and operation.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 2 is an isometric view of the indexing rotary switch assembly incorporated into the welder of FIG. 1, showing the forward area of the switch assembly;

FIG. 4 is a section view taken along line 4—4 of FIG. 1;

FIG. 7 is a section view taken along line 7—7 of FIG. 5;

FIG. 8 is a partial elevation view showing engagement of a pair of mounting bosses associated with adjacent switch assemblies as illustrated in FIGS. 2–6;

FIG. 11 is a section view taken along line 11—11 of FIG. 9;

FIG. 12 is a section view taken along line 12—12 of FIG. 9;

FIG. 17 is a partial front elevation view similar to FIG. 5, showing the rotary contact member moved to a position between adjacent stationary contact areas of the base;

FIG. 18 is a partial section view taken along line 18—18 of FIG. 17;

FIG. 19 is a partial section view taken along line 19—19 of FIG. 5;

FIG. 20 is an enlarged partial section view illustrating a portion of the rotary contact member shown in FIGS. 18 and 19 moved into engagement with a ramp member forming a part of a lift and detent arrangement incorporated into the rotary switch assembly of FIGS. 2–7;

FIG. 23 is an elevation view illustrating the rotary contact member incorporated into the rotary switch assembly of FIG. 21;

FIG. 24 is a partial section view taken along line 24—24 of FIG. 22;

DETAILED DESCRIPTION OF THE INVENTION

Figure 1:
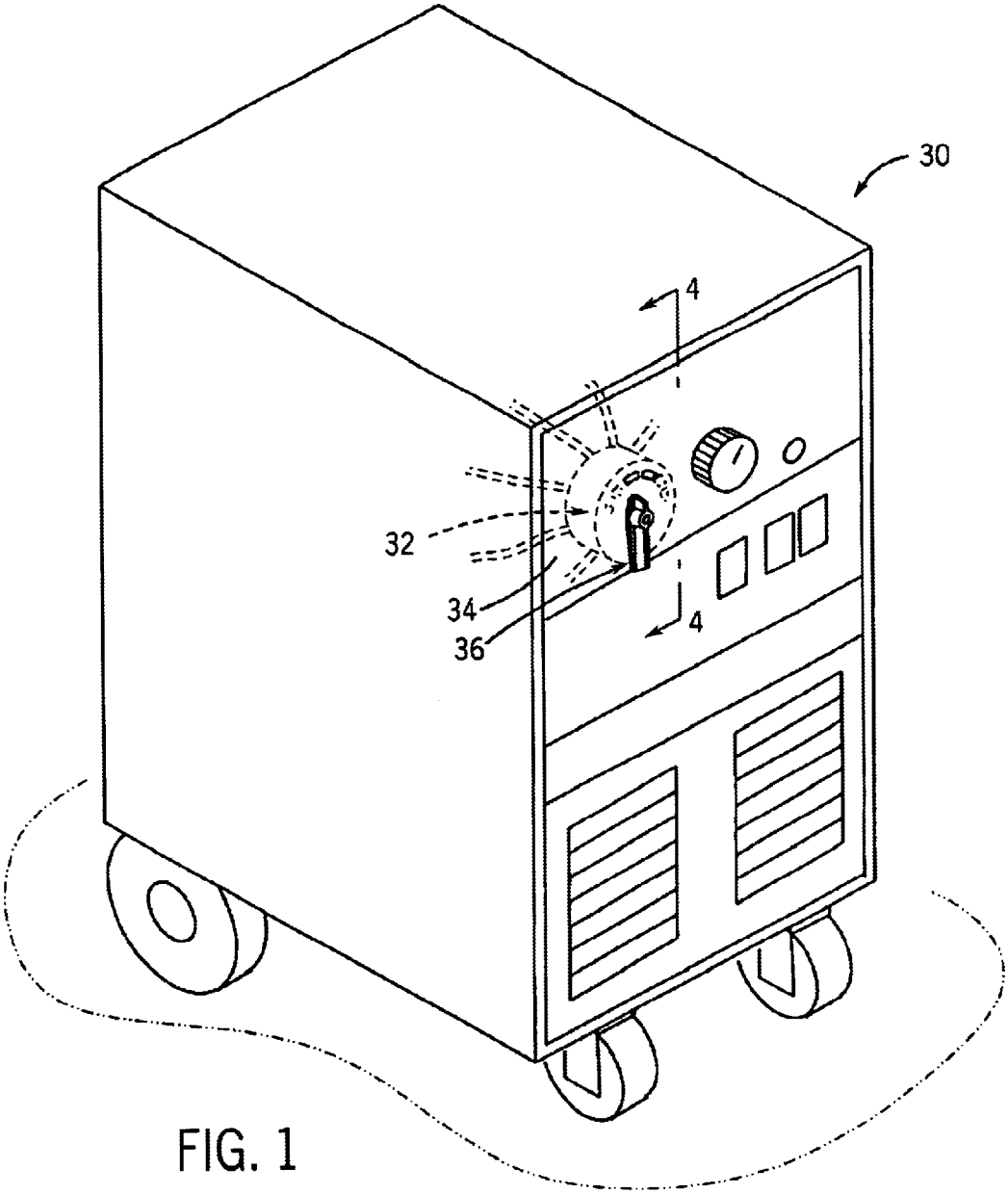
FIG. 1 is an isometric view of an electrical arc welder incorporating the indexing rotary switch assembly of the present invention.

FIG. 1 illustrates an electrical arc welder 30 incorporating a rotary indexing switch assembly 32, constructed according to the invention, for varying the settings of welder 30. Welder 30 includes a face plate 34 to which rotary indexing switch assembly 32 is mounted, in a conventional manner. Switch assembly 32 includes a switch handle 36 located exteriorly of face plate 34, and the remaining components of switch assembly 32 are located interiorly of face plate 34. The general construction and operation of welder 30 is known in the art, and representatively welder 30 may be a welder such as is available from the Miller Electric Mfg. Co. of Appleton, Wis. under its designation Bobcat 250NT, 225NT or 225D.

Referring to FIG. 2, switch assembly 32 generally includes a base member 38 to which a series of radially spaced contact members 40 are mounted, a rotary contact member 42, and an operating assembly 44 which includes a central actuator shaft 46 and switch handle 36.

Figure 3:
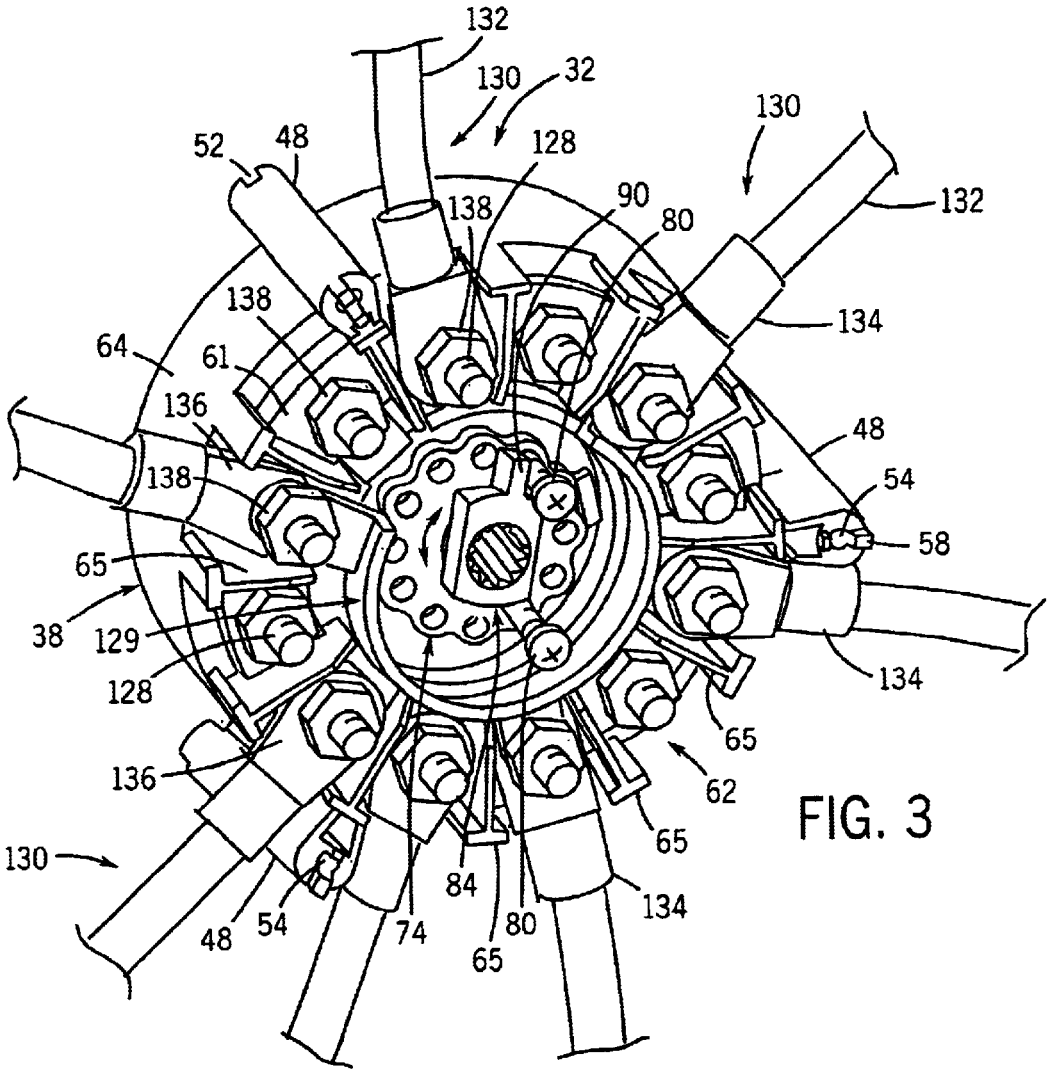
FIG. 3 is an isometric view of the indexing rotary switch assembly of FIG. 2, showing the rearward portion of the switch assembly.

As shown in FIGS. 2–4, a series of mounting bosses 48 are formed integrally with base member 38. Each mounting boss 48 terminates in a forward end 50 within which a slot 52 is formed. A passage 54 extends inwardly from slot 52. Fasteners 56, such as screws, extend through face plate 34 and into passages 54 for securing base member 38, and thereby switch assembly 32, in position within the interior of welder 30. At its rear end, each mounting boss 48 defines a tab 58 which is aligned with the slot 52 formed in forward end 50. Passage 54 extends throughout the length of each mounting boss 48, and emerges from the rear end of each mounting boss 48 to define an opening in tab 58.

Figure 5:
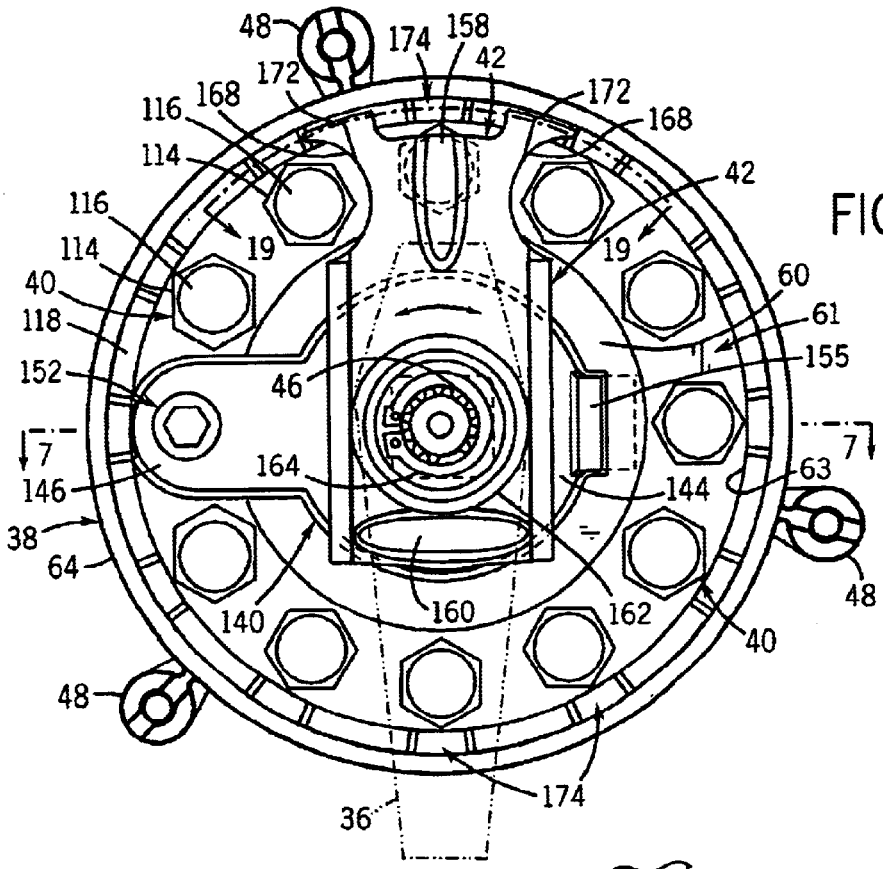
FIG. 5 is a front elevation view of the switch assembly of FIGS. 2–4.
Figure 6:
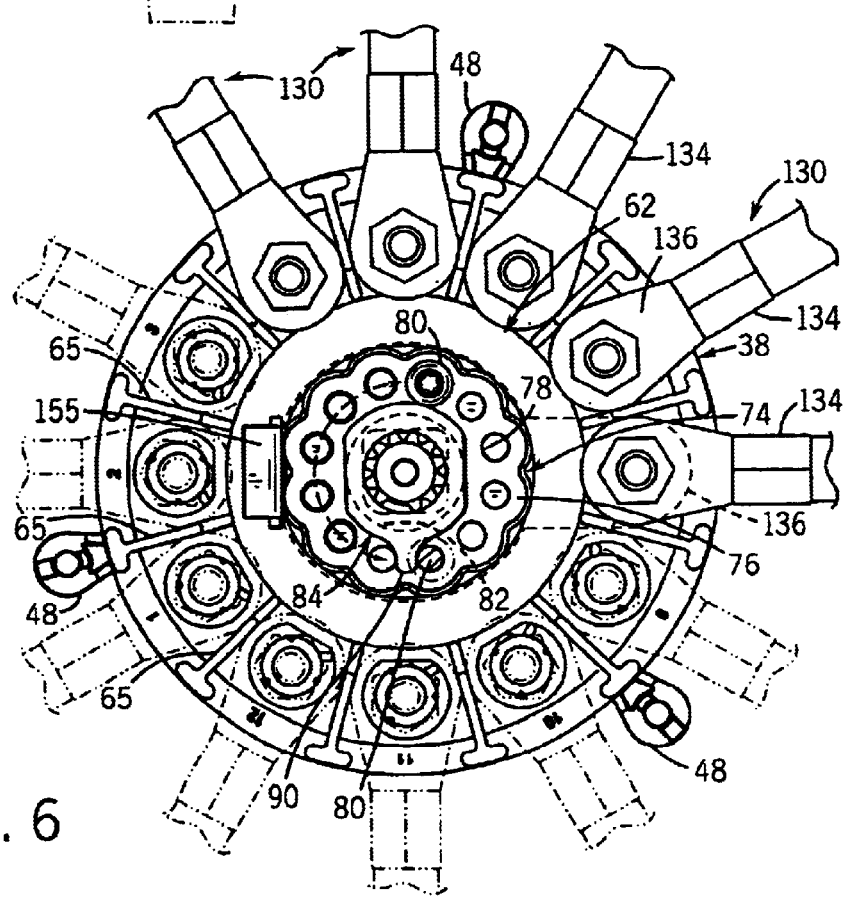
FIG. 6 is a rear elevation view of the switch assembly of FIGS. 2–4.

As shown in FIGS. 5 and 6, base member 38 includes a main body section having a front 60 which includes exposed contact members 40, as well as an oppositely facing rear 62. Base member 38 includes an integral forwardly extending side wall 64, which extends forwardly from front 60. The edge of side wall 64 engages the inner surface of face plate 34, as shown in FIG. 4, to create a dust shield preventing entry of dust or other contaminants into the interior defined by side wall 64 in combination with front 60 of base member 38.

Referring to FIGS. 5–7 and 25–30, base member 38 is constructed of an insulating ring 61 that is received within a circular opening 63 formed in front 60 of base member 38. Base member 38 includes a series of radially spaced apart connectors 65 that extend across opening 63 to interconnect the inner and outer portions or base member 38. The rear of insulating ring 61 includes radially spaced recesses 67 that are configured to receive connectors 65 when insulating ring 61 is received within opening 63. In this manner, engagement of connectors 65 within recesses 67 functions to maintain insulating ring 61 in engagement with base member 38 such that insulating ring 61 is prevented from rotation relative to base member 38.

The front of insulating ring 61 includes a series of non-circular recesses 69, which may representatively be hexagonal in shape. Ring 61 further defines a series of radially spaced rearwardly extending contact receivers 68, each of which defines a rearwardly facing surface 70. Each of radially spaced recesses 67 is located between a pair of adjacent contact receivers 68. At its center, base member rear 62 includes a lobed stop section 74 which includes a rearwardly facing surface 76 and a series of passages 78 which extend forwardly from rearwardly facing surface 76. A pair of stop members, in the form of threaded screws 80, are engaged within a selected pair of passages 78.

Actuator shaft 46 extends through a central passage 82 defined by base member 38. At its rear end, actuator shaft 46 defines a head 84 having a transverse dimension greater than central passage 82. Head 84 has a rear surface 86 and a side surface 88. An outwardly extending stop tab 90 extends from side surface 88, and a forwardly extending splined passage 92 extends forwardly from rear surface 86. Head 84 further defines a forwardly facing shoulder 94 which engages rearwardly facing surface 76 of stop section 74. Stop tab 90 extends radially outwardly from head side surface 88 so as to overlap passages 78, such that stop tab 90 is engageable with stop screws 80, as will later be explained.

Forwardly of rear head 84, actuator shaft 46 includes a cylindrical mounting section 96 which is received within central passage 82 defined by base member 38, and a reduced diameter forward section 98 which terminates in an externally splined forward stem 100 to which switch handle 36 is mounted. For reasons to be explained, forward section 98 of actuator shaft 46 includes a square section 99 located adjacent the forward end of mounting section 96. Handle 36 includes a hub 104 defining a rearwardly facing internally splined passage 106, which mates with externally splined forward stem 100 of actuator shaft 46. An axial passage 108 is formed in forward stem 100, and a threaded fastener, such as a screw 110, extends through an aperture 112 formed in hub 104 and into engagement with passage 108, for non-rotatably mounting handle 36 to actuator shaft 46.

With reference to FIGS. 2–7, 18, 19, 28 and 29, each contact member 40 includes a forward head section 114 defining an exposed front surface 116. Recesses 69, which extend inwardly from the front surface of insulating ring 61, have a shape corresponding to that of contact head section 114. Each recess 69 includes an outer shoulder 122. Each recess 69 communicates with an internal passage, shown at 124, defined by each contact receiver 68. The outer area of each contact head section 114 engages shoulder 122 of recess 69, and each contact 40 further defines a body section 126 received within contact receiver passage 124. A shoulder 127 is located at the rearward end of each body section 126, and a threaded shank 128 extends rearwardly from shoulder 127.

As shown in FIG. 3, a series of bridging rear contact members or buss bars 129 are connected between selected ones of contact members 40. Rear contact members 129 function to interconnect selected cable assemblies, shown at 130, which in turn provide the input and output from switch assembly 32, with each selected set of interconnected cable assemblies 130 providing predetermined settings, parameters or operating characteristics of welder 30. In the drawings, rear contact members 129 are shown as being located radially inwardly of contact members 40. It is also understood that rear contact members 129 may be located radially outwardly of contact members 40.

Base member 38 is preferably formed of any satisfactory material, such as thermoplastic or thermoset material in any satisfactory process, such as by injection molding. Contact members 40 are formed of an electrically conductive material separately from base member 38 and may be engaged with base member 38 subsequent to formation of base member 38, by inserting contact head section 114 and body section 126 into recess 69 and passage 124, respectively, until the rear edge of head section 114 engages shoulder 122. A cable assembly, such as 130, is then engaged with each contact member 40 in predetermined locations according to the desired configuration of switch assembly 32. Each cable assembly 130 includes a cable 132 and a sleeve 134 engaged with the end of cable 132 in a manner as is known. At its outer end, each sleeve 134 is interconnected with a flat contact section 136, which includes an opening through which contact member shank 128 extends. In the drawings, each sleeve 134 is illustrated as extending radially outwardly from its associated flat contact section 136. In another arrangement, a bend is located between each sleeve 134 and its associated flat contact section 136, such that sleeve 134 extends perpendicularly in a rearward direction from its associated flat contact section 134. As shown in FIG. 7, contact section 136 engages rearwardly facing shoulder 127 of contact member 40 defined between body section 126 and shank 128. A nut 138 is threaded onto contact member shank 128, into engagement with sleeve contact section 136, for establishing an electrical connection between cable 132 and contact member 40.

Referring to FIGS. 5 and 7, a center contact 140 is engaged with base member 38. Center contact 140 defines a central opening 142 and an annular contact section 144 which is received within a correspondingly shaped recess formed in front base surface 118. Center contact 140 further includes an outward extension 146. Outward extension 146 is engaged with the outwardly facing surface of a contact member 148, which includes a threaded passage in alignment with an opening 150 formed in outward extension 146. A connector, in the form of a screw 152, is engaged with outward extension 146 of center contact 140. Screw 152 includes a head 153 and a threaded shank 154. The threads of shank 154 are engaged within the threaded passage in contact member 148 to establish electrical contact between center contact 140 and contact member 148 via engagement of screw head 153 with the outwardly facing surface of outward extension 146 of center contact 140. In a manner similar to that described with respect to contact member 40, a cable assembly 130 is engaged with contact member 148 through engagement of a cable assembly contact section 136 sandwiched between the end of contact member 148 and a nut 138 which is threadedly engaged with shank 154, to establish electrical contact of a cable 132 with center contact 140 through outward extension 146.

Center contact 140 further includes an outwardly extending engagement tab 155 (FIGS. 6, 7), which extends opposite outward extension 146. A recess 157 is formed in rear 62 of base member 38, and terminates rearwardly of front base surface 118. Engagement tab 155 extends into recess 157 below front base surface 118. With this construction, center contact 140 is maintained in engagement with base member 38 by engagement tab 155 in combination with screw 152.

Figure 13:
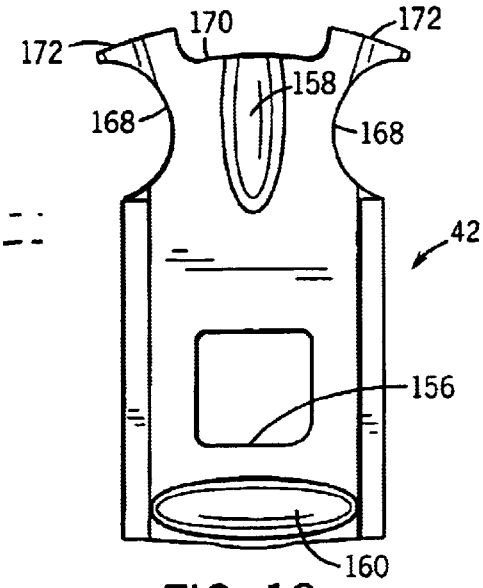
FIG. 13 is a plan view of a rotary contact member incorporated into the rotary switch assembly of FIGS. 2–7.
Figure 16:
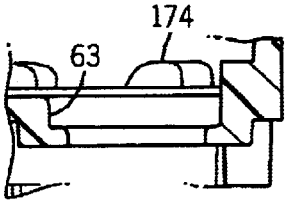
Figure 14:
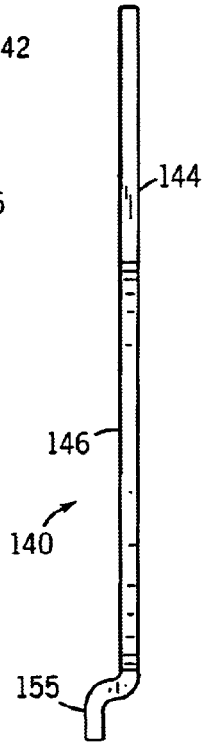
FIG. 14 is a side elevation view of a center contact member incorporated into the rotary switch assembly of FIGS. 2–7.
Figure 9:
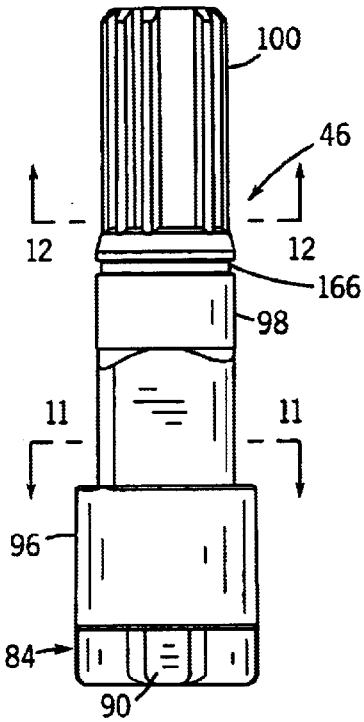
FIGS. 9 and 10 are elevation views of the actuator shaft incorporated in the rotary switch assembly of FIGS. 2–7.
Figure 10:
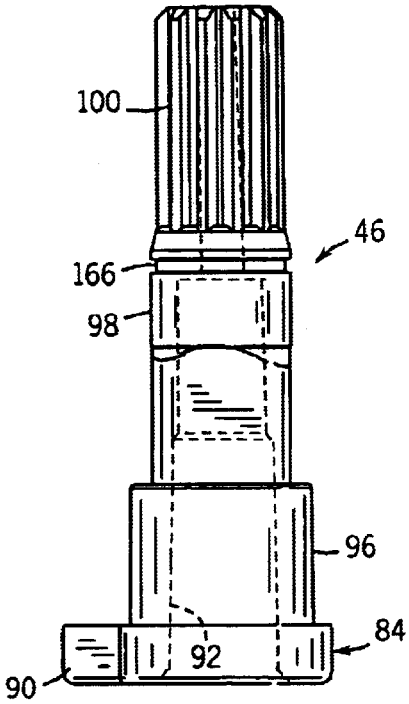
Figure 21:
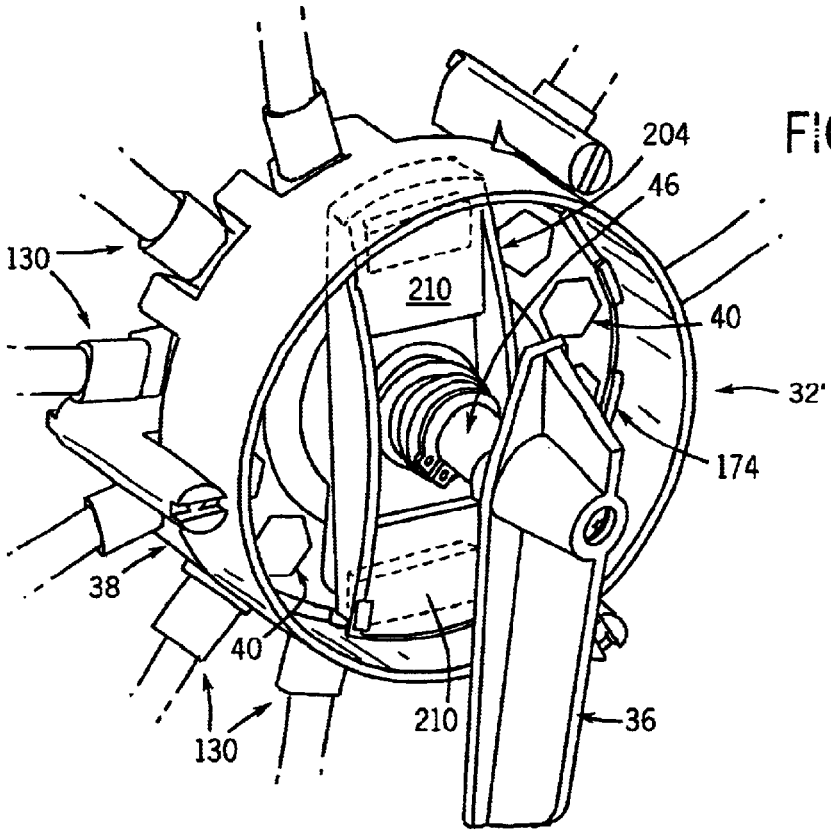
FIG. 21 is an isometric view similar to FIG. 2, showing another embodiment of a rotary contact arrangement incorporated into the rotary switch assembly.
Figure 22:
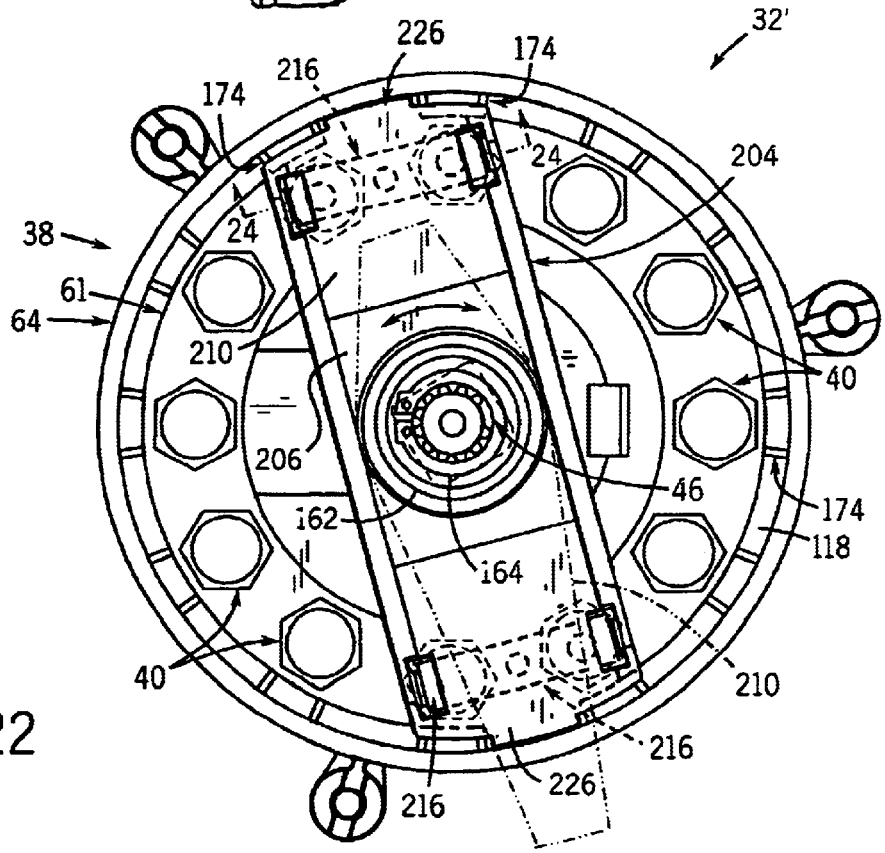
FIG. 22 is a front elevation view of the rotary switch assembly of FIG. 21.
Figure 25:
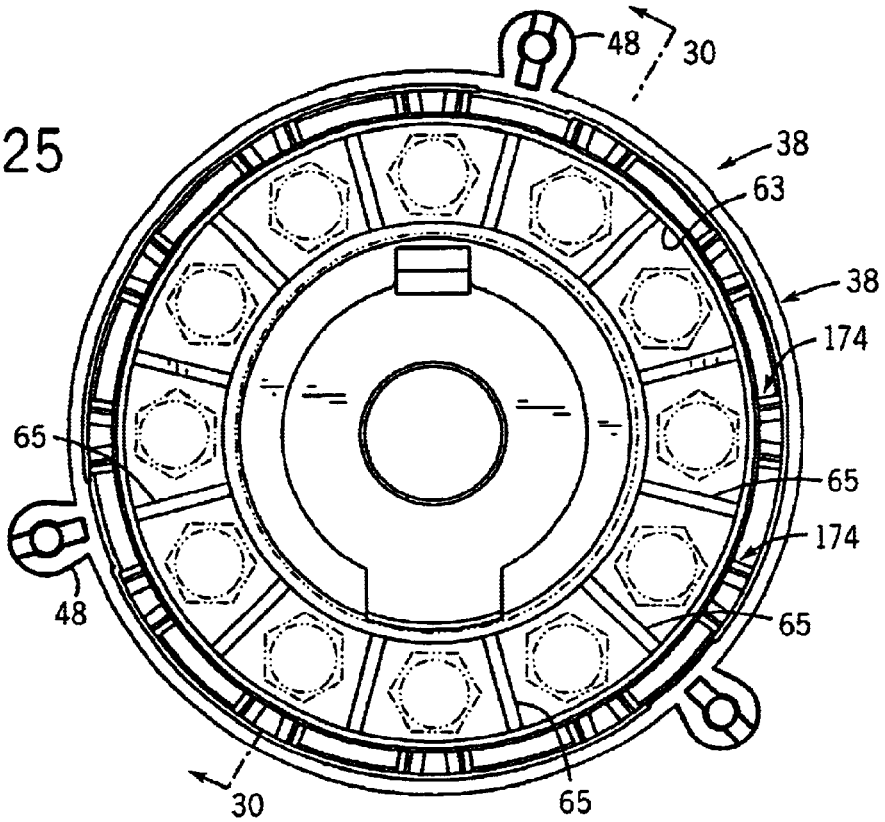
FIG. 25 is a front elevation view of a base incorporated into the switch assembly of FIGS. 2–4.
Figure 26:
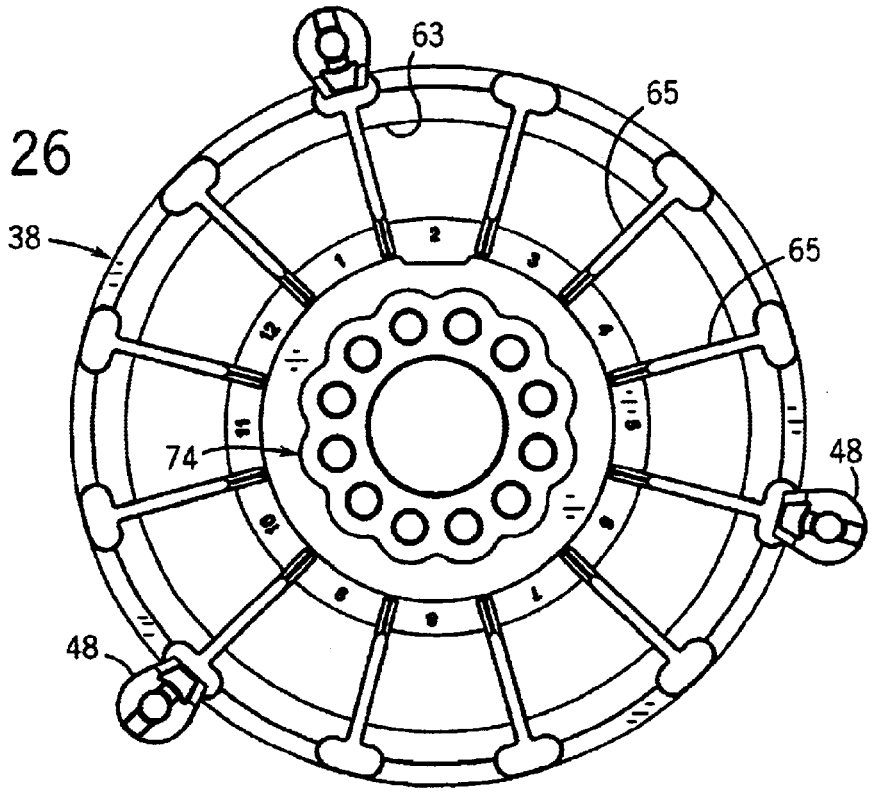
FIG. 26 is a rear elevation view of the switch assembly base of FIG. 25.
Figure 27:
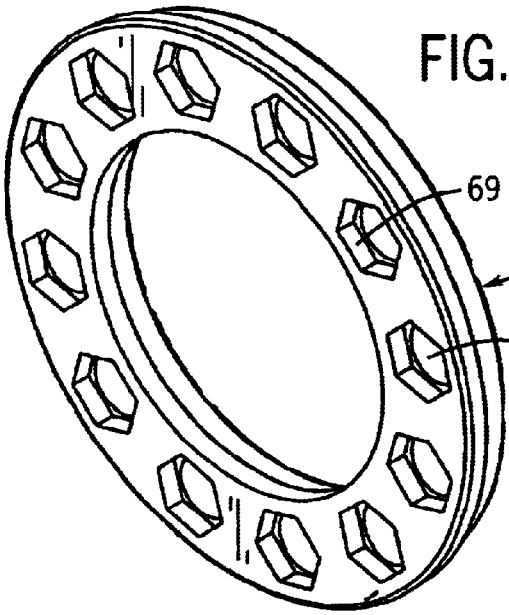
FIG. 27 is an isometric view of an insulating ring adapted for use in combination with the base of FIG. 25, for incorporation into the switch assembly of FIGS. 2–4.
Figure 28:
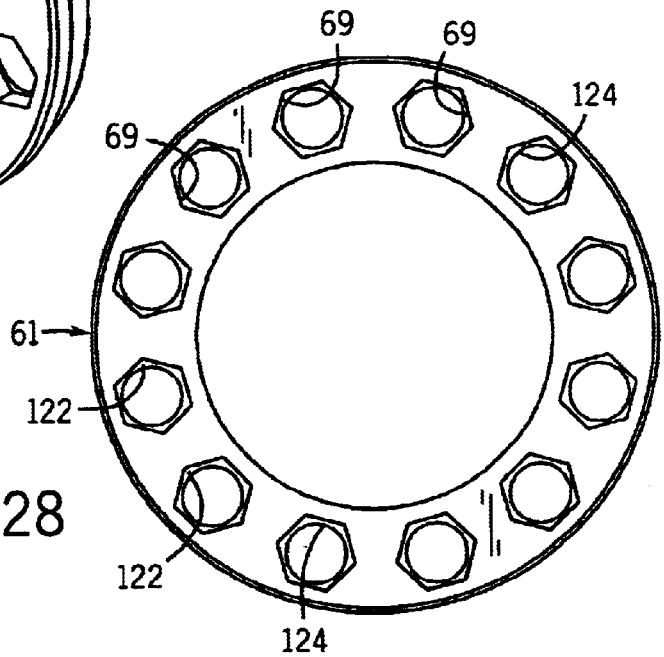
FIG. 28 is a front elevation view of the insulating ring of FIG. 27.
Figure 29:
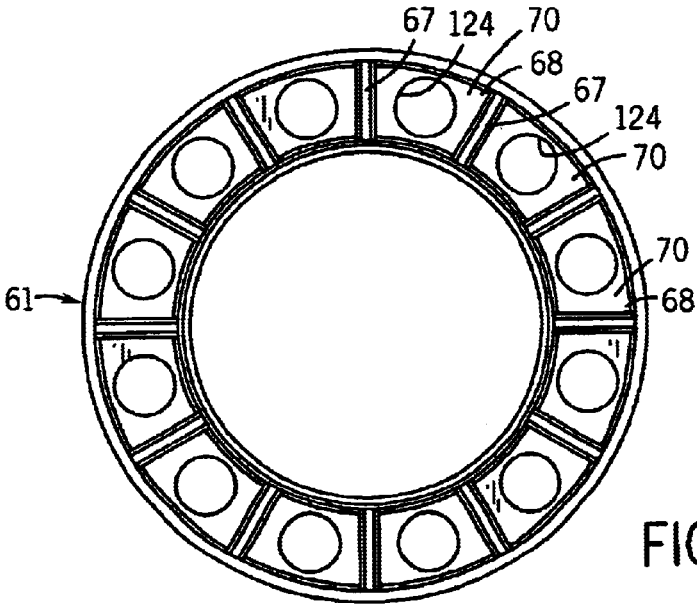
FIG. 29 is a rear elevation view of the insulating ring of FIG. 28.
Figure 30:
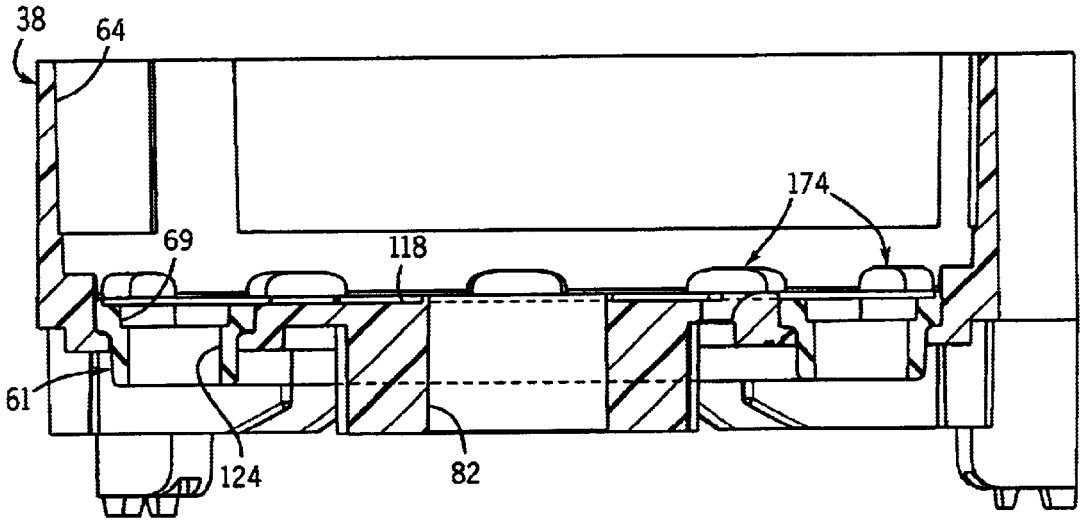
FIG. 30 is a section view taken along line 30—30 of FIG. 25.

Rotary contact member 42 is engaged with actuator shaft 46 so as to be rotatable with actuator shaft 46. Referring to FIG. 13, rotary contact member 42 includes a square opening 156, and square section 99 of actuator shaft 46 has a square cross-section corresponding to the shape of opening 156. In this manner, rotation of actuator shaft 46 causes pivoting movement of rotary contact member 42 relative to base member 38, about a pivot axis defined by the longitudinal axis of actuator shaft 46.

Rotary contact member 42 further includes an outer contact depression 158 and an inner contact depression 160. Outer contact depression 158 overlies front surfaces 116 of contact member head sections 114, and inner contact depression 160 overlies annular contact section 144 of center contact 140. A tapered coil spring 162 defines an enlarged rearward end which is seated within an insulating spacer 163 (FIG. 7) that bears against the forward surface of rotary contact member 42. Spring 162 further defines a narrowed forward end which engages a snap ring 164 received within a groove 166 formed in actuator shaft forward section 98. With this construction, actuator shaft 46 is retained on base member 38 for pivoting movement, and spring 162 provides a biasing force urging rotary contact member 42 toward front face surface 118. In this manner, inner contact depression 160 is urged by spring 162 into engagement with the forward surface of annular contact section 144, and outer contact depression 158 is urged toward head section front surfaces 116.

Rotary contact member 42 further includes a pair of arcuate outer recesses 168 located one on either side of outer contact depression 158. At its outer end, rotary contact member 42 is formed with an outwardly facing recess 170, and a pair of engagement wings 172 located one on either side of recess 170. As shown in FIG. 5, arcuate outer recesses 168 are oriented and sized such that, when outer contact depression 158 is aligned with and engaged with one of contact members 40, the adjacent contact members 40 are in alignment with recesses 168 so that no portions of rotary contact member 42 overlie the adjacent contact members 40. Rotary contact member 42 is sized such that wings 172 are located closely adjacent the inside surface of side wall 64, at the intersection between side wall 64 and front base surface 118.

Referring to FIG. 5, front 60 of base member 38 further includes a series of ramps 174 located at the intersection of side wall 64 with front base surface 118. Each ramp 174 is located outwardly of one of contact members 40. Ramps 174 are formed integrally with side wall 64 and front base surface 118. As shown in FIGS. 18 and 19, each ramp 174 includes a flat outer surface 176 and a pair of angled ramp surfaces 178 extending in opposite directions from outer surface 176, terminating in a pair of side edges 180, each of which extends between the outer end of one of ramps 178 and front base surface 118.

In operation, switch assembly 32 functions as follows to control the settings of arc welder 30, wherein an electrical current path is established from cable assembly 130 to contact member 40, from contact member 40 to rotary contact member 42, from rotary contact member 42 to center contact 140, from center contact 140 to contact member 148, and from contact member 148 to cable assembly 130. In order to change the settings of arc welder 30, the user manually applies a rotary force to switch handle 36 to move switch assembly 32 from a position in which rotary contact member 42 moves from engagement with one of contact members 40 to another of contact members 40. Rotation of switch handle 36 is transferred through engagement of switch handle splined passage 106 with splined forward stem 100, to rotate actuator shaft 46. This in turn causes rotation of rotary actuator member 42 through engagement of actuator shaft forward section 98 with square opening 156 in rotary contact member 42. As rotary contact member 42 is rotated in this manner, the rear surface of outer contact depression 158 slides along front surface 116 of contact member head sections 114. When the rear surface of outer contact depression 158 reaches the edge of front surface 116, one of wings 172 comes into engagement with the ramp surface 178 of a ramp 174 located at the adjacent contact member 40, as shown in FIG. 20. Continued rotary movement of rotary contact member 42 causes the wing 172 to move onto ramp outer surface 176. Simultaneously, the opposite wing 172 comes into engagement with a ramp surface 178 of the ramp 174 located at the contact member 40 which rotary contact member 42 is being moved away from. This engagement of wings 172 with ramps 174 functions to lift the outer end of rotary contact member 42 away from front base surface 118 against the force of spring 162, and thereby to lift the rear surface of outer contact depression 158 upwardly out of engagement with contact member head section 114. Continued rotary movement of actuator shaft 46 through switch handle 36 places rotary contact member 42 in a position as shown in FIG. 18, wherein outer contact depression 158 is located midway between adjacent contact members 40. As rotation of rotary contact member 42 continues, wings 172 continue to move along ramp outer surfaces 176 and come into position over the opposite ramp surfaces 178. The force of coil spring 162 forces rotary contact member 42 rearwardly toward front base surface 118, which functions to maintain inner contact depression 160 against the forwardly facing surface of annular contact section 144 of center contact 140, and simultaneously causes the outer end of rotary contact member 42 to move forwardly as wings 172 move along ramp surfaces 178. Rotary movement of rotary contact member 42 continues until wings 172 are disengaged from ramps 174, as shown in FIG. 19, which results in the rear surface of outer contact depression 158 coining into engagement with front surface 116 of contact head section 114 of the adjacent contact member 40, under the influence of coil spring 162.

Wings 172 and ramps 174 are positioned and constructed so as to provide a detent for maintaining outer contact depression 158 in engagement with front surface 116 of contact member head section 114. That is, any rotation of rotary contact member 42 away from its engaged position of FIG. 19 results in engagement of one of wings 172 with the ends of ramp surfaces 178 of a pair of adjacent ramps 174, such that subsequent additional rotation is resisted by the rearward force exerted on rotary contact member 42 by spring 162. This prevents rotary contact member 42 from being moved out of contact with the selected contact member 40 in response to an inadvertent movement of switch handle 36. The size of recess 170 and the orientation of wings 172 are such that the rear surface of outer contact depression 158 remains in engagement with head section front surface 116 when wings 172 initially contact ramp surfaces 178 in this manner. Any further rotation of rotary contact member 42 beyond this point results in wings 172 riding along ramp surfaces 178, which lifts the outer end of rotary contact member 42 away from front base surface 118 to disengage outer contact depression 158 from front surface 116. With this construction, rotary contact member 42 has a positive detent at each incremental engaged position, which eliminates any uncertainty on the part of the user as to whether rotary contact member 42 is engaged with a contact member 40 when switch handle 36 is moved to a desired setting. The user continues application of the rotary force to switch handle 36 until the desired setting is attained. At each setting of switch assembly 32, the detent arrangement provided by wings 172 and ramps 174 must be overcome by the rotary force applied by the user, until the desired switch setting is attained.

As shown in FIGS. 3 and 6, stop screws 80 are positioned relative to stop section 74 so as to control the range of movement of rotary switch member 42. Stop tab 90 defined by head 84 at the rear end of actuator shaft 46 engages stop screws 80, to provide a positive stop against rotation of actuator shaft 46 when certain positions of rotary contact member 42 are attained. In a typical application, stop screws 80 are placed so as to prevent rotary contact member 42 from being moved into alignment with outward extension 146 of center contact 140 and its associated connector 152. Additional contact positions on either side of outward extension 146 may be unused according to the number of available settings for switch assembly 32 and the specifications of welder 30, and stop screws 80 are positioned in appropriate ones of passages 78 so as to provide the desired range of movement of rotary contact member 42. In an application in which all available positions are employed, a single stop screw, 80 may be utilized and placed in the passage 78 corresponding to center contact outward extension 146, so that rotary contact member 42 can be placed in all available contact positions other than outward extension 146.

As shown in FIGS. 4 and 7, the switch assemblies 32 can be stacked one on top of another, such that an additional switch assembly **32*a* is employed in combination with the switch assembly 32 mounted to face plate 34 and with which switch handle 36 is engaged. Switch assembly 32*a* has the same general construction and operation as switch assembly 32, with the exception that there is no switch handle 36 for second switch assembly 32*a*. Instead, the splined forward stem 100 of the actuator shaft of switch assembly 32*a* is engaged within the splined passage 92 of the actuator shaft of switch assembly 32, such that the rotary contact members of the switch assemblies 32 and 32*a* rotate together. Alternatively, switch assembly 32*a* may have any other satisfactory rotary switch configuration. In a stacked application, second switch assembly 32*a* is positioned rearwardly of first switch assembly 32. Mounting bosses 48*a* of second switch assembly 32*a* are aligned with mounting bosses 48 of first switch assembly 32 (as shown in FIG. 8), and the tab 58 defined by the rearward end of each mounting boss 48 is received within the forwardly facing slot 52*a* of the corresponding mounting boss 48*a*. The base member 38*a* of second switch assembly 32*a* is thus aligned with base member 38 of first switch assembly 32. To ensure proper alignment between actuator shaft 46 of first switch assembly 32 and the actuator shaft of second switch assembly 32*a*, the splines of passage 92 are formed such that a solid area 184 (FIG. 11) is located in an area between a pair of splines, wherein a spline would normally be located. Actuator shaft forward stem 100*a* includes a corresponding blank area 186*a* (FIG. 12), which mates with solid area 184 to ensure that actuator shaft 46*a* of second switch assembly 32*a* is in a desired orientation relative to actuator shaft 46 of first switch assembly 32. The splined engagement of actuator shaft 46***a* with actuator shaft 46 ensures that the switch rotary contact members, such as 42, rotate together when handle 36 is rotated to change the settings of welder 30.

When second switch assembly 32*a* is installed, the length of each fastener 56 is sufficient to enable the fastener shank to pass completely through mounting boss passage 54 and into engagement with the passage 54*a* of one of mounting bosses 48*a* of second switch assembly 32*a*. This functions to draw second switch assembly 32*a* toward first switch assembly 32, to secure first switch assembly 32 and second switch assembly 32*a* together.

Figure 15:
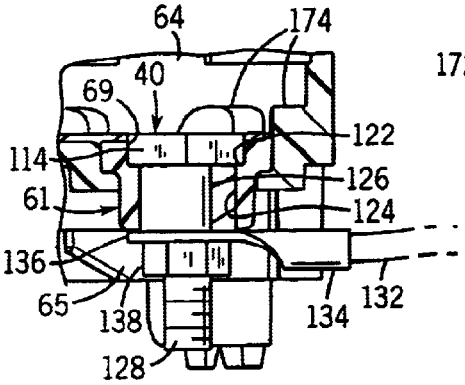
FIGS. 15 and 16 are enlarged partial section views of an outer peripheral contact portion incorporated into the base of the switch assembly of FIGS. 2–7.

Referring to FIG. 15, each contact member 40 is pushed into place such that the irregular shape of head 114 is oriented in alignment with the corresponding irregular shape of recess 69, and contact member 40 is then pushed rearwardly to press contact member body section 126 into contact-receiving passage 124 and the rearward edge of head 114 into engagement with shoulder 122. During initial assembly of switch assembly 32, an adhesive may be used to maintain contact members 40 in engagement with insulating ring 61. In final assembly, a nut, such as 138, is engaged with contact member shank 128 and tightened down toward the rearwardly facing shoulder of contact member body section 126, to clamp sleeve contact section 136 into engagement with rearwardly facing shoulder 127 of contact member body section 126.

FIGS. 21–24 illustrate an alternative switch assembly 32'. The majority of the components of switch assembly 32' are the same as described with respect to switch assembly 32, and like reference characters will be used to facilitate clarity.

Switch assembly 32' includes base member 38, contact members 40, actuator shaft 46 and switch handle 36, in the same manner as switch assembly 32. In switch assembly 32', center contact 140 is eliminated. Switch assembly 32' includes a bridging rotary contact member 204 engaged with actuator shaft 46 and rotatable in response to rotation of actuator shaft 46 through switch handle 36. In the same manner as rotary contact member 42, coil spring 162 urges bridging rotary contact member 204 rearwardly toward front base surface 118.

Bridging rotary contact member 204 includes a central area 206 having a square opening 208 which has a shape corresponding to that of actuator shaft forward section 98. Coil spring 162 bears against central area 206 to urge bridging rotary contact member 204 rearwardly. A pair of contact sections 210 are located one on either side of central area 206. Each contact section 210 includes a pair of depending contact mounting fingers 212 (FIG. 24) terminating in inwardly extending tabs 214. Opposite ends of a bridging contact 216 are engaged by tabs 214, to mount bridging contact 216 to rotary contact member 204. Each contact section 210 includes a depending protrusion 218 extending downwardly from a rear surface 220. Bridging contact 216 has a mating recess 222 within which protrusion 218 is received. With this construction, bridging contact 216 is moved inwardly into engagement with tabs 214, between fingers 212, and deflects slightly until protrusion 218 is received within recess 222, for securely maintaining bridging contact 216 in engagement with its associated contact section 210. Alternatively, a retainer such as an e-ring may be employed to maintain bridging contact 216 in engagement with rotary contact member 204. Each bridging contact 216 includes a pair of laterally spaced contact depressions 224, which have a center-to-center spacing the same as that of contact members 40.

A depending cam member 226 is located at the outer end of each contact section 210. Each cam member 226 has a rear surface 228 and a pair of ramp-like cam surfaces 230. The width of each cam member 226 is slightly smaller than the transverse dimension of the space between adjacent ramps 174 of base member 38.

In operation, bridging rotary contact member 204 functions to establish contact between opposite pairs of adjacent contact members 40 or a single pair of adjacent contact members 40. Bridging rotary contact member 204 is movable in an indexing fashion so as to establish electrical contact between selected adjacent pairs of contact members 40 according to the desired setting of switch assembly 32'. When bridging rotary contact member 204 is in an operative position, as shown in FIG. 24, contact depressions 224 engage front surfaces 116 of adjacent contact head sections 114, to establish contact therebetween through bridging contact 216. When it is desired to change the settings of welder 30, the user manually rotates switch handle 36, to impart rotation to bridging rotary contact member 204 through actuator shaft 46. As contact member 204 is rotated, one of cam surfaces 230 rides along one of ramp surfaces 174, to lift contact member 204 upwardly away from front base surface 118, and to move contact depressions 224 out of engagement with head section front surfaces 116 against the force of coil spring 162. At each increment of rotation of contact member 204, spring 162 forces contact member 204 rearwardly toward front base surface 118, and cam member surfaces 228, 230 engage surfaces 176, 178 of ramps 174 to facilitate repeated lifting of contact member 204 during such rotation. When the desired location of contact member 204 is attained, further application of manual rotary force to switch handle 36 is discontinued, and contact member 204 is positioned as shown in FIG. 24 to establish an electrical connection between adjacent contact members 40. When rotary contact member 204 is in its engaged position as shown, the edges of cam surfaces 230 engage the edges of ramp surfaces 178, to provide a positive detent against further rotation of rotary contact member 204 until application of a subsequent rotary force to switch handle 36.

The invention has been shown and described with various details, and it is understood that alternative configurations are possible. For example, details of the driving configuration between switch handle 36, actuator shaft 46 and rotary contact members 42, 204 may vary. Switch handle 36 may be engaged with actuator shaft 46 utilizing a driving connection other than mating splines, such as any type of irregular mating cross-section. The same holds true for the square mating engagement between actuator shaft 46 and contact members 42, 204, which may be in the form of any type of irregular cross-section or other type of driving connection. Further, the provision of contact depressions on rotary contact member 42 and bridging contacts 216 may be replaced with other types of protruding contact structure, which may or may not be integrally formed with the contact member. Contact member head sections 114 are illustrated with front surfaces 116 being flush with front base surface 118, whereas the contact surfaces of contact members 40 may be in any type of flush, recessed or protruding configuration. In addition, center contact 140 has been illustrated as being retained in place using an offset bent section in combination with a connector, and other types of retainer arrangements may be employed, such as recessed connectors or mounting other than in a flush-mounted manner. The tab-and-slot connection of mounting bosses in a stacked switch configuration may be replaced with any type of engagement arrangement providing mating engagement structure. While fasteners such as screws are shown as being receivable within passages 54 for mounting switch member 32 and adjacent switch member 32*a*, it is understood that any other type of mounting arrangement may be employed, such as separate fasteners mounting one switch to the housing of welder 30 and the second switch assembly to the first. Further, other types of removable and selectively engageable stop structure may be employed for limiting pivoting movement of the actuator shaft in place of engagement of stop screws 80 within passages 78.

In addition, the interaction of the various ramps and cam surfaces, which lift the rotary contact member upon rotation and which provide a positive detent against rotation, may be replaced with other similar structure on the base and contact member, and is not limited to the particular configuration illustrated and described. For example, ramps and cam surfaces may be located inwardly of the contact members rather than outwardly.

Further, it is understood that the features of insulating ring 61 may be incorporated into base member 38, and vice versa.

In another embodiment, the contact member passages may be initially closed via flashed-over transverse walls that initially close the contact member passages. In this arrangement, the heads of the contact members are pushed through selected ones of the flashed-over wall to install the contact members. In the event a contact passage does not receive a contact member, the flashed-over wall remains intact to maintain the passage closed. It is understood that other types of selectively openable arrangements may also be employed. For example, contact-receiving passages 124 may be formed so as to be fully open, and removable plugs may be utilized for closing off selected passages 124 according to the design and specifications of the switch.

As can be appreciated, the same switch base member can be employed for producing a variety of switch assemblies having different specifications and operation, according to the number and placement of the contact members, the bus bars and the type of rotary actuator member employed. The invention thus provides significant cost savings in manufacture and parts inventory, and provides a great deal of flexibility in the type of switch assembly being produced. In addition, replacement of defective components in the switch assembly is significantly easier than in the past, wherein many of the contact components were embedded or insert molded into the material of the base. The individual components can be easily replaced as desired, for repair or retrofitting so as to alter the switch configuration or specifications.

In addition to the above, various alternatives and embodiments are contemplated as being within the scope of the following claims particularly pointing out and distinctly claiming the subject matter regarded as the invention.

I claim:

1. A rotary indexing switch assembly, comprising:

a base having a series of radially spaced stationary contact areas;

a rotary contact arrangement mounted for rotary movement relative to the base, wherein the rotary contact arrangement includes at least one rotary contact area, wherein the rotary contact arrangement is movable to a plurality of contact positions in which the rotary contact area of the rotary contact arrangement engages at least one of the stationary contact areas of the base;

wherein the base includes a series of radially spaced passages, and wherein the stationary contact areas are defined by a plurality of contact members, wherein each of the contact members is received within one of the passages in the base subsequent to manufacture of the base, wherein the contact members are positioned within selected ones of the passages according to a desired operating configuration of the switch assembly;

a combination lift and detent arrangement formed integrally with the base and the rotary contact arrangement for lifting the rotary contact area of the rotary contact arrangement away from the stationary contact areas of the base upon rotation of the rotary contact arrangement between the stationary contact areas, and for releasably maintaining the rotary contact arrangement in a selected one of the contact positions;

a center contact engaged with the base and defining a stationary center contact area, wherein the rotary contact arrangement includes a rotary inner contact area engageable with the stationary center contact area upon rotation of the rotary contact arrangement, wherein the center contact and the base include cooperating engagement structure for engaging the center contact with the base subsequent to manufacture of the base;

wherein the rotary contact arrangement includes an actuator shaft rotatably mounted to the base, wherein the actuator shaft includes a forward section located forwardly of the base and a rearward section located rearwardly of the base, wherein the forward section of the actuator shaft mounts an actuator handle which is manually engageable by a user for imparting rotation to the rotary contact arrangement;

wherein at least a second rotary indexing switch assembly is mounted rearwardly of the base, wherein the first and second rotary indexing switch assemblies include respective first and second actuator shafts, wherein the forward section of the second actuator shaft and the rearward section of the first actuator shaft include mating engagement structure for imparting rotation to the second actuator shaft upon rotation of the first actuator shaft;

a conical spring interposed between the actuator shaft and the rotary contact arrangement for biasing the rotary contact areas toward the radially spaced stationary contact areas of the base;

an enclosure wall formed integrally with the base, wherein the radially spaced stationary contact areas are located in a contact surface defined by the base, and wherein the enclosure wall and the contact surface cooperate to define an internal cavity within the stationary contact areas and the rotary contact area are located.

2. A rotary indexing switch assembly, comprising:

a base defining a plurality of stationary contact areas;

a rotary contact arrangement mounted for rotary movement relative to the base, wherein the rotary contact arrangement includes at least one rotary contact area, wherein the rotary contact arrangement is movable to a plurality of contact positions in which the at least one rotary contact area of the rotary contact arrangement engages at least one of the plurality of stationary contact areas of the base;

an insulating member separate from the base and mounted to the base, wherein the insulating member includes a series of radially spaced passages; and a plurality of contact members engaged within the series of radially spaced passages of the insulating member, wherein each of the radially spaced passages in the insulating member receives one of the contact members, wherein the plurality of contact members define the plurality of contact areas, and wherein the contact members are positioned within selected ones of the passages in the insulating member according to a desired operating configuration of the switch assembly.

3. The rotary indexing switch assembly of claim 2, wherein at least a first one of the contact members is inserted into a first one of the passages in the base, and wherein the first passage in the base includes a transverse wall that is pierced by the first contact member as the first contact member is inserted into the first passage.

4. The rotary indexing switch assembly of claim 2, wherein the rotary contact arrangement comprises an actuator shaft rotatably mounted to the base, and a rotary contact member engaged with the actuator shaft and rotatable therewith, wherein the rotary contact member includes at least one rotary contact area engageable with the stationary contact areas defined by the contact members.

5. A rotary indexing switch assembly, comprising:

a base having a series of radially spaced stationary contact areas;

a rotary contact arrangement mounted for rotary movement relative to the base, wherein the rotary contact arrangement includes at least one rotary contact area, wherein the rotary contact arrangement is movable to a plurality of contact positions in which the at least one rotary contact area of the rotary contact arrangement engages at least one of the stationary contact areas of the base;

wherein the base includes a series of radially spaced passages, and wherein the stationary contact areas are defined by a plurality of contact members, wherein each of the contact members is received within one of the passages in the base subsequent to manufacture of the base, wherein the contact members are positioned within selected ones of the passages according to a desired operating configuration of the switch assembly; and a center contact engaged with the base subsequent to manufacture of the base.

6. A rotary indexing switch assembly, comprising:

a base having a series of radially spaced stationary contact areas;

a rotary contact arrangement mounted for rotary movement relative to the base, wherein the rotary contact arrangement includes a rotary contact area, wherein the rotary contact arrangement is movable to a plurality of contact positions in which the rotary contact area of the rotary contact arrangement engages at least one of the series of stationary contact areas of the base; and a combination lift and detent arrangement formed integrally with the base and the rotary contact arrangement for lifting the rotary contact area of the rotary contact arrangement away from the stationary contact areas of the base upon rotation of the rotary contact arrangement between the stationary contact areas, and for releasably maintaining the rotary contact arrangement in a selected one of the contact positions.

7. The rotary indexing switch assembly of claim 6, wherein the combination lift and detent arrangement includes ramp structure formed on the base and at least one lift member associated with the rotary contact arrangement, wherein the at least one lift member engages the ramp structure upon rotation of the rotary contact arrangement to lift the at least one rotary contact area away from the base.

8. The rotary indexing switch assembly of claim 7, wherein the ramp structure comprises a series of individual radially spaced ramps formed integrally with the base, wherein each of the series of ramps is located so as to correspond in location to one of the series of stationary contact areas.

9. The rotary indexing switch assembly of claim 8, wherein the at least one lift member comprises a pair of spaced apart lift members, wherein the rotary contact area is located between the pair of lift members, wherein, when the rotary contact area is in engagement with an engaged one of the stationary contact areas of the base, one of the series of ramps corresponding to the engaged stationary contact area is received between the pair of lift members.

10. The rotary indexing switch assembly of claim 8, wherein the rotary contact arrangement includes a pair of spaced apart rotary contact areas, and wherein the at least one lift member is located between the pair of spaced apart rotary contact areas, wherein, when the spaced apart rotary contact areas are engaged with the first and second of the stationary contact areas of the base, the lift member is engaged with the ramps corresponding to the first and second of the stationary contact areas so as to maintain the spaced apart rotary contact areas in engagement with the first and second of the stationary contact areas.

11. A rotary indexing switch assembly, comprising:

a base having a series of radially spaced stationary contact areas;

a rotary contact arrangement mounted for rotary movement relative to the base, wherein the rotary contact arrangement includes at least one rotary contact area, wherein the rotary contact arrangement is movable to a plurality of contact positions in which the at least one rotary contact area of the rotary contact arrangement engages at least one of the stationary contact areas of the base; and a center contact engaged with the base and defining a stationary center contact area, wherein the at least one rotary contact area of the rotary contact arrangement includes a rotary inner contact area engageable with the stationary center contact area upon rotation of the rotary contact arrangement, wherein the center contact and the base include cooperating engagement structure for engaging the center contact with the base subsequent to manufacture of the base.

12. The rotary indexing switch assembly of claim 11, wherein the rotary contact arrangement includes an actuator shaft rotatably mounted to the base, and wherein the center contact includes an opening through which the actuator shaft extends.

13. The rotary indexing switch assembly of claim 12, wherein the cooperating engagement structure comprises a cooperating engagement arrangement located on one side of the opening, and a fastener engaged between the center contact and the base on the opposite side of the opening.

14. The rotary indexing switch assembly of claim 13, wherein the cooperating engagement arrangement comprises a tab formed on the center contact and a recess formed in the base within which the tab is received for engaging the center contact with the base on one side of the opening.

15. The rotary indexing switch assembly of claim 14, wherein the center contact includes a mounting extension opposite the tab, wherein the fastener is engaged with the mounting extension and is received within an opening formed in the base.

16. A rotary indexing switch assembly, comprising:

a base having a series of radially spaced stationary contact areas;

a rotary contact arrangement mounted for rotary movement relative to the base, wherein the rotary contact arrangement includes at least one rotary contact area, wherein the rotary contact arrangement is movable to a plurality of contact positions in which the at least one rotary contact area of the rotary contact arrangement engages at least one of the stationary contact areas of the base;

wherein the rotary contact arrangement includes an actuator shaft rotatably mounted to the base, wherein the actuator shaft includes a forward section located forwardly of the base and a rearward section located rearwardly of the base, wherein the forward section of the actuator shaft mounts an actuator handle which is manually engageable by a user for imparting rotation to the rotary contact arrangement; and wherein a second rotary indexing switch assembly is mounted rearwardly of the base, wherein the first and second rotary indexing switch assemblies include respective first and second actuator shafts, wherein the forward section of the second actuator shaft and the rearward section of the first actuator shaft include mating engagement structure for imparting rotation to the second actuator shaft upon rotation of the first actuator shaft.

17. The rotary indexing switch assembly of claim 16, wherein the mating engagement structure comprises radially spaced axially extending splines associated with the rearward section of the first actuator shaft and the forward section of the second actuator shaft.

18. The rotary indexing switch assembly of claim 17, wherein the rearward section of the first actuator shaft defines a splined passage and wherein the forward section of the second actuator shaft is received within the passage and defines external splines engageable with the splines of the passage.

19. The rotary indexing switch assembly of claim 16, further comprising positioning means for engaging the forward section of the second actuator shaft with the rearward section of the first actuator shaft in a predetermined position for attaining a predetermined alignment of the rotary contact arrangements of the first and second rotary indexing switch assemblies.

20. The rotary indexing switch assembly of claim 19, wherein the mating engagement arrangement comprises a series of radially spaced axially extending splines associated with the forward section of the second actuator shaft and the rearward section of the first actuator shaft, and wherein the positioning means comprises a mating irregularity formed in the splines.

21. The rotary indexing switch assembly of claim 16, further comprising a series of mounting members provided on the base of each of the first and second rotary switch assemblies, wherein the mounting members include an axially extending passage and wherein the second switch assembly is engaged with the first switch assembly via a fastener extending through the passage of each of the series of mounting members of the first switch assembly into engagement with the passage of each of the series of mounting members of the second switch assembly.

22. A rotary indexing switch assembly, comprising:

a base having a series of radially spaced stationary contact areas;

a rotary contact arrangement mounted for rotary movement relative to the base, wherein the rotary contact arrangement includes at least one rotary contact area, wherein the rotary contact arrangement is movable to a plurality of contact positions in which the at least one rotary contact area of the rotary contact arrangement engages at least one of the stationary contact areas of the base, wherein the rotary contact arrangement includes an actuator shaft and a rotary contact member engaged with the actuator shaft and including the at least one rotary contact area; and a conical spring interposed between the actuator shaft and the rotary contact member for biasing the rotary contact member toward the radially spaced stationary contact areas of the base.

23. The rotary indexing switch assembly of claim 22, wherein the conical spring defines a passage through which the actuator shaft extends, and includes a first end spaced from the contact member and a second end in engagement with the contact member, wherein the second end has a transverse dimension greater than the first end.

24. The rotary indexing switch assembly of claim 23, further comprising a spring retaining member engaged with the actuator shaft and with the first end of the conical spring, wherein the spring retaining member is positioned so as to compress the conical spring to bias the rotary contact member toward the stationary contact areas of the base.

25. The rotary indexing switch assembly of claim 24, wherein the spring retaining member comprises a snap ring engaged within a groove defined by the actuator shaft.

26. A rotary indexing switch assembly, comprising:

a base having a series of radially spaced stationary contact areas;

a rotary contact arrangement mounted for rotary movement relative to the base, wherein the rotary contact arrangement includes at least one rotary contact area, wherein the rotary contact arrangement is movable to a plurality of contact positions in which the at least one rotary contact area of the rotary contact arrangement engages at least one of the stationary contact areas of the base; and an enclosure wall formed integrally with the base;

wherein the radially spaced stationary contact areas are located in a contact surface defined by the base, wherein the enclosure wall and the contact surface cooperate to define an internal cavity within which the stationary contact areas and the at least one rotary contact area are located.

27. The rotary indexing switch assembly of claim 26, wherein the enclosure wall defines an end spaced from the contact surface, wherein the rotary indexing switch assembly is mounted to a member and wherein the end of the enclosure wall is engageable with the member to enclose the internal cavity defined by the enclosure wall and the contact surface.

28. The rotary indexing switch assembly of claim 27, further comprising mounting structure associated with the base for use in mounting the rotary indexing switch assembly to the member.

29. The rotary indexing switch assembly of claim 28, wherein the mounting structure comprises a plurality of mounting bosses, wherein each of the plurality of mounting bosses includes an axial passage that receives a fastener extending through the member for engaging the switch assembly with the member.

30. The rotary indexing switch assembly of claim 29, wherein each mounting boss is located exteriorly of the internal cavity defined by the enclosure wall and the contact surface.

31. The rotary indexing switch assembly of claim 27, wherein the rotary contact arrangement includes an actuator shaft rotatably mounted to the base and a rotary contact member engaged with and movable with the actuator shaft, wherein the rotary contact member includes the at least one rotary contact area, and farther comprising a biasing arrangement interposed between the actuator shaft and the rotary contact member for biasing the rotary contact member toward the contact surface, wherein the rotary contact member and the biasing arrangement are located within the internal cavity defined by the contact surface and the enclosure wall.

32. A rotary indexing switch assembly, comprising:

a base having a series of radially spaced stationary contact areas;

a rotary contact arrangement mounted for rotary movement relative to the base, wherein the rotary contact arrangement includes at least one rotary contact area, wherein the rotary contact arrangement is movable to a plurality of contact positions in which the at least one rotary contact area of the rotary contact arrangement engages at least one of the stationary contact areas of the base; and a selectively positionable stop arrangement interposed between the rotary contact arrangement and the base for controlling the range of rotary movement of the rotary contact arrangement relative to the base.

33. The rotary indexing switch assembly of claim 32, wherein the base includes a forward area and a rearward area, wherein the forward area contains the radially spaced stationary contact areas and wherein the rearward area contains the selectively positionable stop arrangement.

34. The rotary indexing switch assembly of claim 33, wherein the rotary contact arrangement includes an actuator shaft rotatably engaged with the base, and wherein the actuator shaft is engageable with the stop arrangement for controlling the range of rotary movement of the actuator shaft, and thereby the rotary contact arrangement, relative to the base.

35. The rotary indexing switch assembly of claim 34, wherein the actuator shaft includes a head portion located adjacent a surface defined by the rearward area of the base, wherein the head portion includes an outwardly extending engagement member, and wherein the stop arrangement includes at least one stop member extending from a surface defined by the rearward area of the base, wherein the engagement member is engageable with the stop member for controlling the range of movement of the actuator shaft relative to the base.

36. The rotary indexing switch assembly of claim 34, wherein the stop arrangement comprises a pair of stop members selectively engageable with the rearward area of the base.

37. The rotary indexing switch assembly of claim 36, wherein the rearward area of the base defines a surface having a series of radially spaced apertures, wherein the pair of stop members are selectively engageable within a selected pair of the apertures, wherein the stop members are positioned within a selected pair of the apertures which correspond to the range of rotary movement of the rotary contact arrangement relative to the base.

38. A method of producing a rotary indexing switch assembly, comprising the steps of:

providing a base having a series of radially spaced stationary contact areas;

providing an actuator shaft;

providing a first rotary contact member having a first contact area constructed and arranged to engage the series of stationary contact areas in a first configuration;

providing a second rotary contact member having at least one second rotary contact area constructed and arranged to engage the series of stationary contact areas in a second configuration; and securing either the first rotary contact member or the second rotary contact member to the shaft and rotatably securing the shaft to the base, for providing either a first switch assembly capable of engaging the series of stationary contact areas in the first configuration or a second switch assembly capable of engaging the series of stationary contact areas in the second configuration.

39. The method of claim 38, wherein the step of securing the actuator shaft to the rotary contact member is carried out by passing the actuator shaft through an opening in the selected rotary actuator member and inserting the actuator shaft through a passage in the base.

40. A method of producing a base for a rotary switch assembly having a rotary contact member rotatably mounted to the base, comprising the steps of:

forming the base with a base surface, wherein the base surface faces in a first direction and wherein the rotary contact member is adapted to be placed adjacent the base surface; and selectively engaging a plurality of contact members with the base after the base is formed, wherein each of the plurality of contact members has a contact surface facing generally in the first direction and configured for engagement with the rotary contact member, wherein the step of engaging the plurality of contact members with the base is carried out by forming a plurality of passages in an insulating ring and selectively engaging the plurality of contact members within selected ones of the plurality of passages in the insulting ring, and engaging the insulating ring with the base.

* * * * *